US005779577A

United States Patent [19]

Erickson

[11] Patent Number: 5,779,577

[45] Date of Patent: Jul. 14, 1998

[54] ARROW SHAFT SELECTION SYSTEM

[76] Inventor: Victor O. Erickson, 1295 Ada Ave., Idaho Falls, Id. 83402

[21] Appl. No.: 725,757

[22] Filed: Oct. 4, 1996

[51] Int. Cl.[6] ..... F42B 6/04

[52] U.S. Cl. ..... 473/578

[58] Field of Search ..... 473/578, 216

[56] References Cited

PUBLICATIONS

Easton Archery, 1993–1994 edition, pp. 1–29.

Easton Target•Field•3–D Shaft Size Selection Chart.

Easton Hunting Shaft Size Selection Chart.

*Primary Examiner*—Mark S. Graham

*Attorney, Agent, or Firm*—Hopkins Roden Crockett Hansen & Hoopes, PLLC

[57] ABSTRACT

A system for selecting an arrow shaft by determining an optimum spine based on a type of bow, a point weight, a peak bow weight, and an arrow shaft length; and a graph for providing a pictorial representation of a relationship between static spine, dynamic spine, and weight per inch of the arrow shaft. In a preferred embodiment, a table which provides an optimum spine for combinations of different bow types, point weights, peak bow weights, and arrow shaft lengths is provided. A preferred method for selecting an arrow shaft comprises the steps of (a) selecting a bow type, (b) selecting a point weight in grains, (c) selecting a peak bow weight, (d) selecting an arrow length, (e) using an optimum spine selection table to determine an optimum spine which corresponds to the selected type of bow, point weight, peak bow weight, and arrow length, (f) selecting a spine versus shaft weight selection chart that corresponds to the optimum spine range, and (g) selecting the arrow shaft from one of a group of arrow shafts within a dynamic spine window on the spine versus shaft weight selection chart.

11 Claims, 2 Drawing Sheets

ARROW SHAFT SELECTION SYSTEM

TECHNICAL FIELD

The present invention relates to an arrow shaft selection system and method. More particularly, the present invention relates to an arrow shaft selection system method which is personalized to an archer's bow, peak bow weight, release aid, point weight, and arrow length to select the optimal arrow shaft.

BACKGROUND OF THE INVENTION

One of the most significant developments affecting modern archery was the advent of the precision arrow shaft. Beginning with aluminum tubing through today's aluminum/carbon and pure carbon shafts, the twentieth century arrow has provided archers with a degree of consistency never before possible. Another significant development was the compound bow. The increased speed and lighter holding weight made shooting a bow much easier and more pleasurable. A third significant development was the release aid. The degree of accuracy afforded archers because of the release aid has been incredible.

In order to obtain the greatest accuracy, an arrow shaft is selected according to the bow type and setup. Arrow shaft selection utilizing concise charts and/or computer programs has only recently emerged in the art. One such product is an EASTON™ shaft selection chart which is published in various forms. This product represents what is currently being utilized by most people within the archery industry for a shaft selection tool. The EASTON™ shaft selection chart has a hunting shaft chart on one side and a target shaft chart on the other side. The chart provides a list of several arrow shafts for each combination of bow type, point weight, peak bow weight, and arrow length. This chart does not indicate the differences between the listed arrow shafts relative to their static and dynamic spines. Spine is defined as a measure of an arrow shaft stiffness. Specifically, it is a measure of a deflection in inches of a 29" shaft supported at each end by supports 28" apart with a 1.94 pound weight suspended from the middle of the shaft. Dynamic spine is a phenomenon that occurs during actual shooting conditions where it has been determined that lighter shafts react more stiffly than heavier shafts having similar static spine ratings. As such, the EASTON™ shaft selection chart does not provide enough information to allow the user to make an educated choice between the listed arrows.

Another shaft selection product is the EASTON™ "Flight Simulator" Shaft Selection System computer software package. This program has four modules, only one of which is a shaft selection system. The EASTON™ "Flight Simulator" Shaft Selection System incorporates both hunting and target shaft selections in one software package. However, this software is very cumbersome and time consuming to use. Additionally, since it is computer software, a computer is obviously required in order to select the proper shaft. Although computers are becoming more widespread, a computer may not always be available when a person would like to select an arrow shaft. An even more serious deficiency with this software is that a user is not provided with all shaft options. Rather, only a few shaft options are indicated by the software.

Several innovations for arrow shaft selection systems have been provided in the prior art that are adapted to be used. Even though these innovations may be suitable for the specific individual purposes to which they address, they would not be suitable for the purposes of the present invention as heretofore described.

Accordingly, objects of the present invention are to provide an arrow shaft selection system and method which is easy to use, comprehensive, and provides the degree of detail necessary for an archer to make an informed selection of an arrow shaft most suited to his preferences.

SUMMARY OF THE INVENTION

According to principals of the present invention in a preferred embodiment, an arrow shaft is selected by first determining an optimum spine of the arrow shaft then selecting the arrow shaft from among those graphically indicated in a spine versus weight per inch chart. According to further principals of the present invention, the optimum spine is determined using an optimum spine selection table. The optimum spine selection table indicates the optimum spine for different bow types, point weights, bow peak weights, and arrow shaft lengths.

One feature of the present invention is that a user focuses on his or her personal shaft selection criteria. This enables a user to graphically compare both the spine and weight of all the shaft types falling within a personal spine range.

In a preferred embodiment, the present invention provides a user with numerous tear-off total arrow weight calculators for creating personal (removable) total arrow weight calculations and comparisons.

Other objects, advantages, and capabilities of the present invention will become more apparent as the description proceeds.

DETAILED DESCRIPTION OF THE INVENTION

Figure 1:
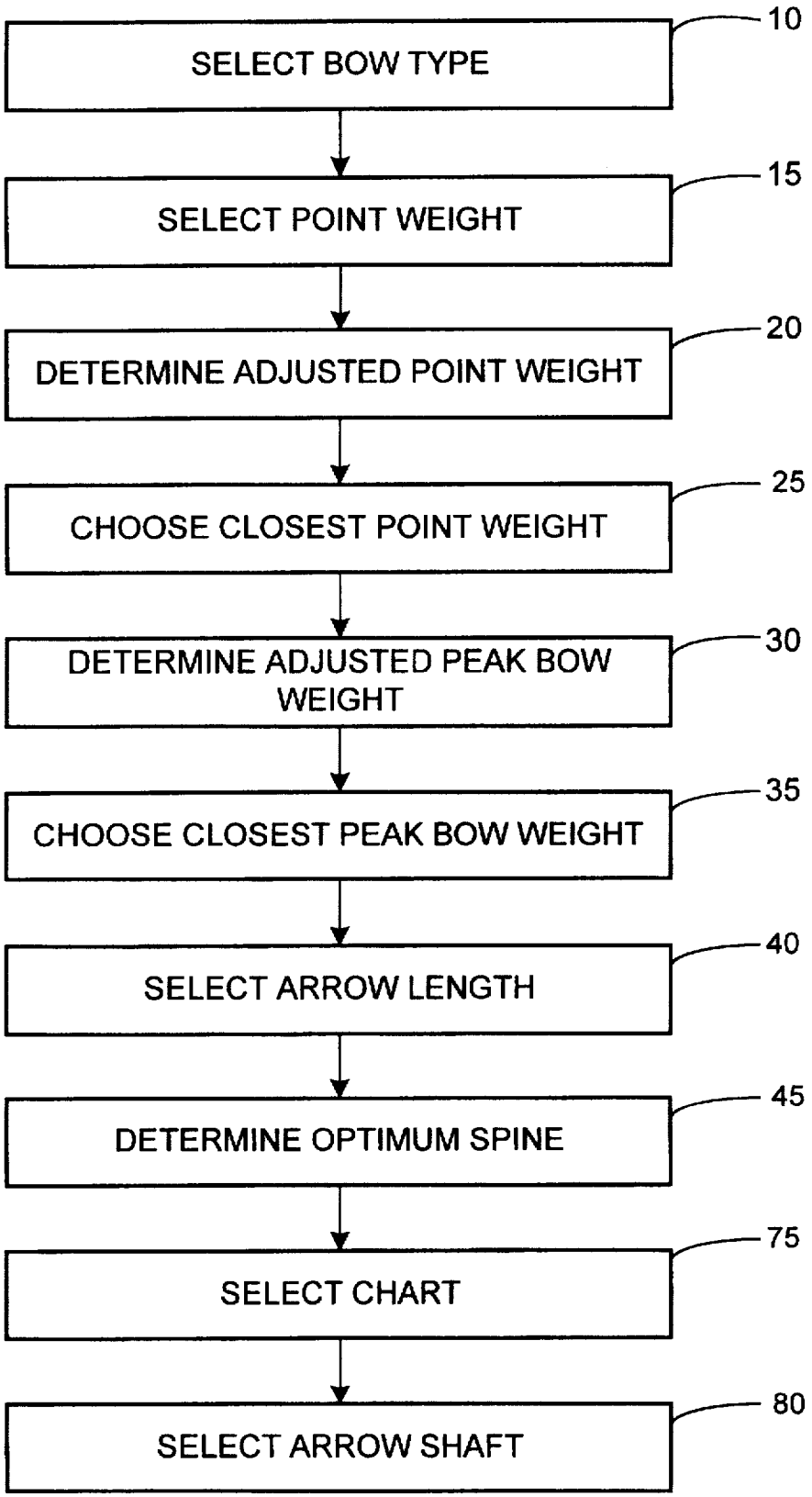
FIG. 1 is a flow chart showing a method of utilizing an arrow shaft selection system.

Table 1 is a preferred optimum spine selection table. Four types of bows are indicated along the top of the table. These are round wheel compound, soft cam compound, hard cam compound, or recurve bows. For each bow type, several point weights are indicated. Several peak bow weights are provided for each point weight for each bow type. Bow weight is the "pull" in pounds required to draw the bowstring. Additionally, several arrow lengths are available for the user to choose from. An optimum spine is provided for each combination of bow type, point weight, peak bow weight and arrow length. However, where a combination results in an optimum spine for which no shafts are currently available, no optimum spine is indicated. An example of this is shown in the lower right corner of Table 1. No optimum spine is indicated for a round wheel bow, a point weight of 75 grains, a peak bow weight of 109 pounds, and an arrow length of 34 inches.

TABLE 1

| | Round Wheel Point Weight in Grains | | | | | Soft Cam Point Weight in Grains | | | | | Hard Cam Point Weight in Grains | | | | |
|---|---|---|---|---|---|---|---|---|---|---|---|---|---|---|---|
| | 75 | 100 | 125 | 150 | 175 | 75 | 100 | 125 | 150 | 175 | 75 | 100 | 125 | 150 | 175 |
| PEAK | 52 | 49 | 46 | 43 | 40 | 47 | 44 | 41 | 38 | 35 | 42 | 39 | 36 | 33 | 30 |
| BOW | 54 | 51 | 48 | 45 | 42 | 49 | 46 | 43 | 40 | 37 | 44 | 41 | 38 | 35 | 32 |
| WEIGHT | 57 | 54 | 51 | 48 | 45 | 52 | 49 | 46 | 43 | 40 | 47 | 44 | 41 | 38 | 35 |
| | 59 | 56 | 53 | 50 | 47 | 54 | 51 | 46 | 45 | 42 | 49 | 46 | 43 | 40 | 37 |
| | 62 | 59 | 56 | 53 | 50 | 57 | 54 | 51 | 48 | 45 | 52 | 49 | 46 | 43 | 40 |
| | 64 | 61 | 58 | 55 | 52 | 58 | 56 | 53 | 50 | 47 | 54 | 51 | 48 | 45 | 42 |
| | 67 | 64 | 61 | 58 | 55 | 62 | 59 | 56 | 53 | 50 | 57 | 54 | 51 | 48 | 45 |
| | 70 | 67 | 64 | 61 | 58 | 64 | 61 | 58 | 55 | 52 | 59 | 56 | 53 | 50 | 47 |
| | 73 | 70 | 67 | 64 | 61 | 67 | 64 | 61 | 58 | 55 | 62 | 59 | 56 | 53 | 50 |
| | 76 | 73 | 70 | 87 | 64 | 70 | 67 | 64 | 61 | 69 | 64 | 61 | 58 | 55 | 52 |
| | 79 | 76 | 73 | 70 | 67 | 73 | 70 | 67 | 64 | 61 | 67 | 64 | 61 | 58 | 55 |
| | 82 | 79 | 76 | 73 | 70 | 76 | 73 | 70 | 87 | 64 | 70 | 67 | 64 | 61 | 59 |
| | 85 | 82 | 79 | 76 | 73 | 79 | 76 | 73 | 70 | 67 | 73 | 70 | 67 | 64 | 61 |
| | 88 | 85 | 82 | 79 | 76 | 62 | 79 | 76 | 73 | 70 | 76 | 73 | 70 | 67 | 64 |
| | 91 | 88 | 85 | 82 | 79 | 85 | 82 | 79 | 76 | 73 | 79 | 76 | 73 | 70 | 67 |
| | 94 | 91 | 88 | 85 | 82 | 88 | 85 | 82 | 79 | 76 | 82 | 79 | 76 | 73 | 70 |
| | 97 | 94 | 91 | 88 | 85 | 91 | 88 | 85 | 82 | 79 | 85 | 82 | 79 | 76 | 73 |
| | 100 | 97 | 94 | 91 | 88 | 94 | 91 | 88 | 85 | 82 | 88 | 85 | 82 | 79 | 76 |
| | 103 | 100 | 97 | 94 | 91 | 97 | 94 | 91 | 88 | 85 | 91 | 88 | 85 | 82 | 79 |
| | 100 | 103 | 100 | 97 | 94 | 100 | 97 | 94 | 91 | 88 | 94 | 91 | 88 | 85 | 82 |
| | 109 | 106 | 103 | 100 | 97 | 103 | 100 | 97 | 64 | 91 | 97 | 94 | 91 | 88 | 85 |

| | Optimum Spine CORRECT ARROW LENGTH in Inches | | | | | | | | | | | | Recurve Bow Point Weight in Grains | | | | |
|---|---|---|---|---|---|---|---|---|---|---|---|---|---|---|---|---|---|
| | 23 | 24 | 25 | 26 | 27 | 28 | 29 | 30 | 31 | 32 | 33 | 34 | 75 | 100 | 125 | 150 | 175 |
| PEAK | | .852 | .777 | .713 | .658 | .613 | .563 | .518 | .490 | .458 | .423 | .398 | 37 | 34 | 31 | 28 | 25 |
| BOW | | .814 | 747 | .688 | .635 | .588 | .540 | .504 | 474 | .440 | .410 | .365 | 39 | 36 | 33 | 30 | 27 |
| WEIGHT | .852 | .777 | .713 | .656 | .613 | .563 | .518 | 490 | .458 | .423 | .398 | .373 | 42 | 39 | 36 | 33 | 30 |
| | .814 | .747 | .688 | .635 | .588 | .540 | .504 | .474 | .440 | .410 | .385 | .366 | 44 | 42 | 38 | 35 | 32 |
| | .777 | .713 | .656 | .613 | .563 | .518 | .490 | .458 | .423 | .398 | .373 | .360 | 47 | 44 | 41 | 38 | 35 |
| | .747 | .688 | .635 | .588 | .540 | .504 | .474 | .440 | .410 | .385 | .366 | .350 | 49 | 46 | 43 | 40 | 37 |
| | .713 | .658 | .613 | .563 | .518 | .490 | ;458 | .423 | .398 | .373 | .360 | .340 | 52 | 49 | 46 | 43 | 40 |
| | .688 | .635 | .585 | .549 | .504 | .474 | .440 | .410 | .385 | .366 | .350 | .330 | 54 | 51 | 48 | 45 | 42 |
| | .658 | .613 | .563 | .516 | .480 | .458 | .423 | .398 | .373 | .360 | .340 | .322 | 57 | 54 | 51 | 48 | 45 |
| | .635 | .588 | .540 | .504 | .474 | .440 | .410 | .385 | .366 | .350 | .330 | .317 | 59 | 56 | 53 | 50 | 47 |
| | .613 | .563 | .516 | .490 | .458 | .423 | .398 | .373 | .360 | .340 | .322 | .312 | 62 | 59 | 56 | 53 | 50 |
| | .588 | .540 | .504 | 474 | .440 | .410 | .385 | .366 | .350 | .330 | .317 | .309 | 64 | 61 | 58 | 55 | 52 |
| | .563 | .518 | .490 | .458 | .423 | .398 | .373 | .360 | .340 | .322 | .312 | .305 | 67 | 64 | 61 | 58 | 55 |
| | .540 | .504 | .474 | .440 | .410 | .385 | .366 | .350 | .330 | .317 | .309 | .300 | 70 | 67 | 64 | 61 | 58 |
| | .518 | .480 | .458 | .423 | .398 | .373 | .360 | .340 | .322 | .312 | .305 | .295 | 73 | 70 | 67 | 64 | 61 |
| | .504 | .474 | .440 | .410 | .385 | .366 | .35a | .330 | .317 | .309 | .300 | | 76 | 73 | 70 | 67 | 64 |
| | .490 | .458 | .423 | .398 | .373 | .380 | .340 | .322 | .312 | .305 | .295 | | 79 | 76 | 73 | 70 | 67 |
| | .474 | .440 | .410 | .385 | .366 | .350 | .330 | .317 | .309 | .300 | | | 82 | 79 | 76 | 73 | 70 |
| | .458 | .423 | .398 | .373 | .360 | .340 | .322 | .312 | .305 | .295 | | | 85 | 82 | 79 | 76 | 73 |
| | .440 | .410 | .385 | .366 | .350 | .330 | .317 | .308 | .300 | | | | 88 | 86 | 82 | 79 | 76 |
| | .423 | .398 | .373 | .360 | .340 | .322 | .312 | .305 | .265 | | | | 91 | 88 | 85 | 82 | 79 |

Although Table 1 is a preferred means for determining the optimum spine, other tables and alternative means may be employed for determining the optimum spine, such as a computer program. Alternative embodiments of Table 1 further include a column for a radical cam bow. It is known in the art that a soft cam is alternatively called an energy cam and a hard cam is alternatively called a speed cam. An alternative embodiment of Table 1 uses these alternative terminologies.

FIG. 1 illustrates a preferred method of determining an optimum spine. First the bow type is selected 10 in Table 1. A point weight is then selected 15 from the list of point weights below the selected bow type. Next, an adjusted point weight is determined 20 by adjusting the actual point weight for heavier tapered aluminum inserts of the following RPS model numbers: (a) #2314 add 10 grains, (b) #2312–2315–2317–2413–2419 add 15 grains, (c) #2514 add 25 grains, (d) #2512 add 30 grains, and (e) #2613 add 35 grains. The user then chooses 25 the point weight from Table 1 which is the closest to the adjusted point weight.

Next, an adjusted peak bow weight is determined 30 by adjusting the actual peak bow weight for the following factors: (a) compound bow lengths less than 43" that are drawn over 28" add 5–7 pounds; (b) finger release for a compound bow add 5–7 pounds; (c) DACRON™ string subtract 3–5 pounds; and (d) overdraw bows multiply adjusted peak bow weight by 1.02 for 1" overdraw, 1.05 for 2" overdraw, 1.09 for 3" overdraw, 1.13 for 4" overdraw; and 1.17 for 5" overdraw. The user then chooses 35 the peak bow weight from Table 1 which is the closest to the adjusted peak bow weight.

An arrow length is then selected 40 from those listed in Table 1 which is closest to the actual arrow length of the user. The actual arrow length is measured from the bottom of the nock groove to the end of the shaft. One inch broadhead clearance past the arrow rest is allowed for bows with cutout sight windows and overdraw bows. One inch broadhead clearance past the far side of the sight window is allowed for bows without cutout sight windows. The optimum spine is then indicated 45 at the intersection of the arrow length column and the peak bow weight row. As an example, the spine 0.852 could have been selected based on a soft cam bow, a point weight of 125 grains, a peak bow weight of 41 pounds and an arrow length of 24 inches.

Figure 2:
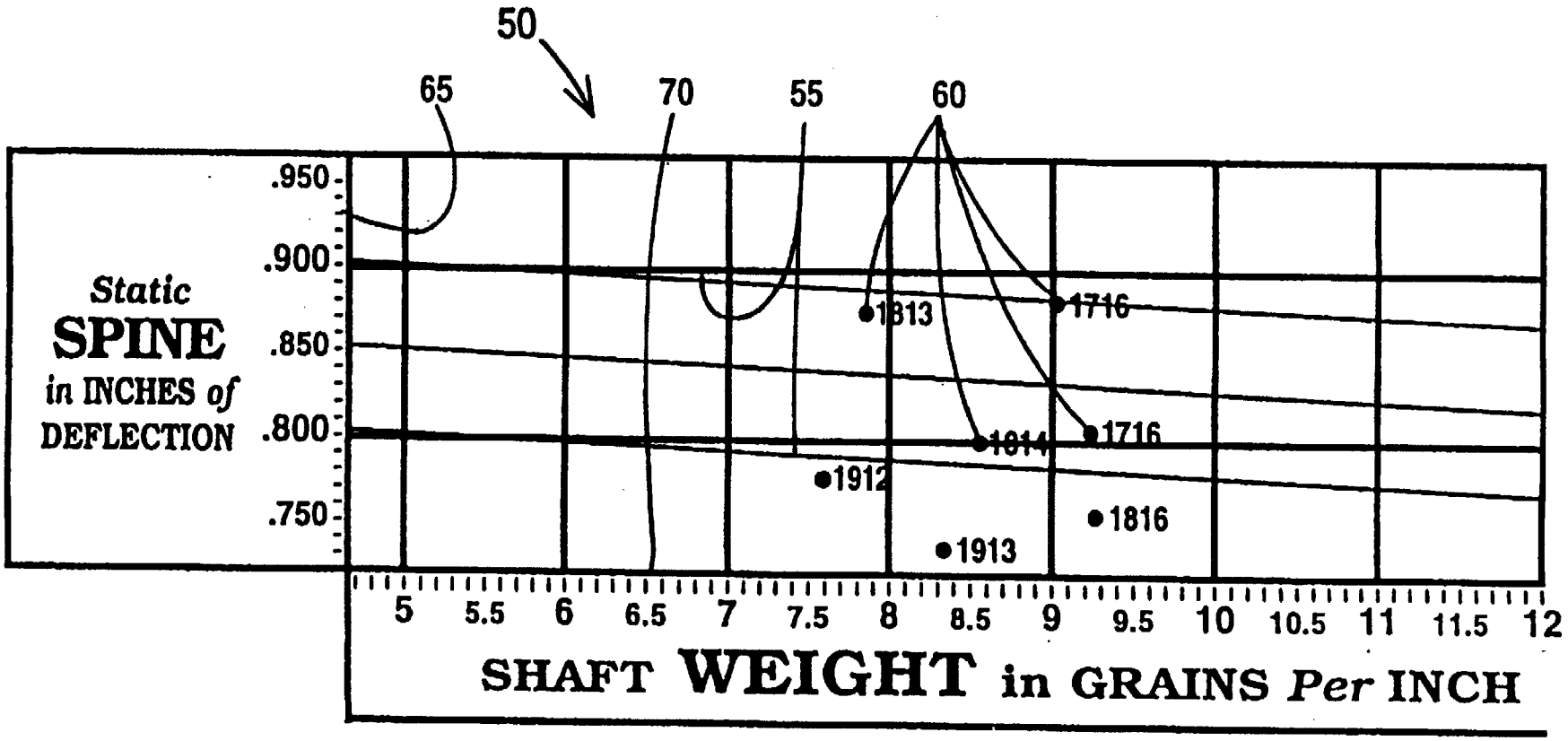
FIG. 2 is a static and dynamic spine versus weight shaft selection chart.

FIG. 2 is a preferred embodiment of a chart 50 indicating the static and dynamic spine versus the weight per inch of selected arrow shafts. FIG. 2 is a chart for an optimum spine of 0.852 and covers a spine range from about 0.730 to 0.950 inches. In a preferred embodiment, the present invention includes multiple charts to cover the whole range of spine deflections indicated in the spine selection Table 1. Chart 50 includes a dynamic spine window bounded by lines 55 and arrow shaft points 60 and model numbers. Points 60 represent arrow shafts having a static spine falling within the range indicated by the y-axis 65 of the Chart 50. The weights per inch of each of the arrow shafts represented by points 60 are determined by referencing X-axis 70.

All points 60 falling within the dynamic spine window, represented by lines 55, indicate recommended shafts. It is noted that there is a downward slope to dynamic spine window lines 55 from lighter to heavier shaft weights. This slope accounts for the dynamic spine phenomenon, i.e., lighter shafts react more stiffly during shooting conditions. All points 60 falling outside the window, represented by lines 55, indicate shafts which are near the recommended range and may optionally be used by the archer. In order for the archer to use a shaft represented by a point 60 above the window, the archer must either increase the point weight or decrease the peak bow weight. In order for the archer to use a shaft represented by a point 60 below the window, the archer must either decrease the point weight or increase the peak bow weight. Providing the archer with a graphic representation of the available shafts allows the archer to select an arrow shaft based on the archer's personal criteria.

Referring again to FIG. 1, a chart 50 is selected 75 which coincides with the optimum spine indicated by spine selection Table 1. The user then selects 80 one of the arrow shafts which fall within or near window 55. The user makes the selection based on the user's personal preferences with respect to the feature of each of the indicated shafts.

In a preferred embodiment, technical data concerning each of the indicated shafts within the dynamic spine window is available to the user adjacent to chart 50. Table 2 is an example of such a table. Table 2 includes information concerning static spine, weight in grains per inch, shaft model, shaft type, maximum length, RPS insert weight, nock system, tensile strength, weight tolerance, and straightness for each arrow shaft. Information such as that indicated on Table 2 is then easily accessible to the user. The user is then able to use the provided information to assist in the selection of an arrow shaft. Providing the information depicted in Table 2 in close proximity to the information depicted in chart 50 provides the archer with readily accessible information with which to make a shaft selection.

Providing information concerning shaft accessory weights and shaft specifications is preferably provided in close proximity to the shaft spine information as in Table 2. Alternatively, shaft accessory weights and shaft specifications are alternatively provided separately from the shaft spine information.

A paper or booklet format is the preferred embodiment of the present invention and is currently the most practicable format in which to introduce it to the archery industry. However, the present invention is alternatively a computerized shaft selection system.

TABLE 2

| Static | GRAINS | SHAFT OPTIONS | | | Bare Hunting Shaft - WEIGHT in GRAINS (Compare at Your Length) | | | | | | | | | | | | |
|---|---|---|---|---|---|---|---|---|---|---|---|---|---|---|---|---|---|
| SPINE | Per Inch | MODEL | TYPE | SIZE | 23 | .5 | 24 | .5 | 25 | .5 | 26 | .5 | 27 | .5 | 28 | .5 | 29 |
| .874 | 7.86 | Autumn Orange | XX75 | 1813 | 181 | 195 | 189 | 193 | 197 | 200 | 204 | 206 | 212 | 218 | 220 | 224 | 228 |
| .799 | 8.57 | Black Eclipse | X7 | 1814 | 197 | 201 | 206 | 210 | 204 | 219 | 222 | 727 | 230 | 226 | 240 | 244 | 249 |
| .880 | 9.03 | Game Getter II | XX75 | 1716 | 208 | 212 | 217 | 221 | 225 | 220 | 235 | 230 | 244 | 240 | 253 | 257 | 262 |
| .880 | 9.03 | Gold E75 | XX76 | 1716 | 208 | 212 | 217 | 220 | 226 | 220 | 235 | 239 | 244 | 245 | 253 | 257 | 262 |
| .806 | 9.24 | Red | Eagle | 1710 | 213 | 217 | 222 | 226 | 231 | 236 | 240 | 245 | 249 | 254 | 250 | 283 | |

| Bare Hunting Shaft - WEIGHT in GRAINS (Compare at Your Length) | | | | | | | | | | | | RS insert WL | | | | | | TENSILE | | STRAIGHTNESS |
|---|---|---|---|---|---|---|---|---|---|---|---|---|---|---|---|---|---|---|---|---|
| .5 | 30 | .5 | 31 | .5 | 32 | .5 | 33 | .5 | 34 | .5 | | LENGTH | Alum | Car-bon | Size | NOCK SYSTEM | Wt. | Bush Wt. | STRENGTH (PSI) | WEIGHT Tolerance | Tolerance (T.I.H.) |
| 232 | 236 | | | | | | | | | | | 30 | 16 | *7 | ¼ | Conventional | 7 | | 96,000 | +/− 7.00% | +/− .002" |
| 263 | 257 | | | | | | | | | | | 30 | 16 nm | *7 | G | Uni-block | 7 | 7 | 105,000 | +/− 0.75% | +/− .001" |
| | | | | | | | | | | | | 29 | 9 | | ¼ | Conventional | 7 | | 96,000 | +/− 1.25% | +/− .003" |
| | | | | | | | | | | | | 29 | 0 | | ¼ | Conventional | 7 | | 96,000 | +/− 1.00% | +/− .003" |
| | | | | | | | | | | | | 28.5 | 0 | | ¼ | Conventional | 7 | | 56,000 | +/− 4.00% | +/− .006" |

Italics are theoretically possible but extend beyond the bounds of the Selection Guide.
Calculating Total Arrow Weight (Example bottom left): Add the weight of all applicable shaft accessories - See back panel Minimum Total Arrow Weight restrictions may apply Check your State Bow hunting Regulations. Minimum Total Arrow Weight for Pope & Young is 400 grains
*See Gel Guide Adj. Pt. Weight The present invention preferably includes a hunting shaft selection system and a separate target shaft selection system. In an alternate embodiment, the present invention is universal in nature incorporating both the hunting shaft selection system and the target shaft selection system into one.

It will be understood that each of the elements described above, or two or more together, may also find a useful application in other types of constructions differing from the type described above.

While the invention has been illustrated and described as embodied in an arrow shaft selection system, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

While the present invention has been described by reference to specific embodiments, it will be apparent that other alternative embodiments and methods of implementation or modification may be employed without departing from the true spirit and scope of the invention.

What is claimed is:

1. A system for selecting an arrow shaft, the system comprising:

(a) means for determining an optimum spine based on a type of bow, a point weight, a peak bow weight, and an arrow shaft length; and (b) graphic means for providing a pictorial representation of a relationship between static spine, dynamic spine, and weight per inch of the arrow shaft.

2. The system of claim 1 wherein the means for determining includes an optimum spine selection table providing an optimum spine for selected combinations of the type of bow, the point weight, the peak bow weight, and the arrow shaft length.

3. The system of claim 1 wherein the graphic means includes at least one spine versus shaft weight chart depicting the static and dynamic spine of selected arrow shafts versus the weight of the arrow shafts per inch.

4. The system of claim 1 further comprising means for providing technical data concerning the arrow shaft.

5. The system of claim 1 further comprising means for providing shaft accessory weights.

6. A system for selecting an arrow shaft, the system comprising:

(a) means for determining an optimum spine based on a type of bow, a point weight, a peak bow weight, and an arrow shaft length; and (b) graphic means for providing a pictorial representation of a relationship between static spine, dynamic spine, and weight per inch of the arrow shaft, wherein the graphic means includes multiple spine versus shaft weight charts depicting the static and dynamic spine of selected arrow shafts versus the weight of the arrow shafts per inch.

7. The system of claim 6 wherein the means for determining includes an optimum spine selection table providing an optimum spine for selected combinations of the type of bow, the point weight, the peak bow weight, and the arrow shaft length.

8. The system of claim 6 further comprising means for providing technical data concerning the arrow shaft.

9. The system of claim 6 further comprising means for providing shaft accessory weights.

10. A method of selecting an arrow shaft dynamic spine method comprising the steps of:

(a) selecting a bow type;

(b) selecting a point weight in grains;

(c) selecting a peak bow weight;

(d) selecting an arrow length;

(e) using an optimum spine selection table to determine an optimum spine which corresponds to the selected type of bow, point weight, peak bow weight, and arrow length;

(f) selecting a spine versus shaft weight per inch selection chart that corresponds to the optimum spine range; and (g) selecting the arrow shaft from one of a group of arrow shafts within a dynamic spine window on the spine versus shaft weight per inch selection chart.

11. The method of claim 10, further comprising using technical data of each arrow shaft in the group of arrow shafts within the dynamic spine window to select the arrow shafts from the group of arrow shafts.

* * * * *